US007187125B2

(12) United States Patent
Yoon et al.

(10) Patent No.: US 7,187,125 B2
(45) Date of Patent: Mar. 6, 2007

(54) PLASMA DISPLAY PANEL

(75) Inventors: Cha-Keun Yoon, Suwon (KR); Jung-Keun Ahn, Cheonan (KR); Min-Sun Yoo, Cheonan (KR)

(73) Assignee: Samsung SDI Co., Ltd., Suwon-si (KR)

( * ) Notice: Subject to any disclaimer, the term of this patent is extended or adjusted under 35 U.S.C. 154(b) by 124 days.

(21) Appl. No.: 10/704,984

(22) Filed: Nov. 12, 2003

(65) Prior Publication Data

US 2004/0113553 A1 Jun. 17, 2004

(30) Foreign Application Priority Data

Dec. 17, 2002 (KR) ..... 10-2002-0080804
Jan. 15, 2003 (KR) ..... 10-2003-0002682

(51) Int. Cl.
*H01J 17/49* (2006.01)

(52) U.S. Cl. ..... 313/582

(58) Field of Classification Search ..... 313/582–587, 313/292; 315/169.1, 169.3, 169.4
See application file for complete search history.

(56) References Cited

U.S. PATENT DOCUMENTS

| | | | | |
|---|---|---|---|---|
| 4,827,186 | A | 5/1989 | Knauer et al. | |
| 5,541,618 | A | 7/1996 | Shinoda | |
| 5,661,500 | A | 8/1997 | Shinoda et al. | |
| 5,663,741 | A | 9/1997 | Kanazawa | |
| 5,674,553 | A | 10/1997 | Sinoda et al. | |
| 5,724,054 | A | 3/1998 | Shinoda | |
| 5,786,794 | A | 7/1998 | Kishi et al. | |
| 5,952,782 | A | 9/1999 | Nanto | |
| RE37,444 | E | 11/2001 | Kanazawa | |
| 6,608,441 | B2 * | 8/2003 | Kunii et al. | 313/584 |
| 6,630,916 | B1 | 10/2003 | Shinoda | |
| 6,683,589 | B2 * | 1/2004 | Sano et al. | 345/60 |
| 6,707,436 | B2 | 3/2004 | Setoguchi et al. | |
| 6,747,409 | B1 * | 6/2004 | Han et al. | 313/582 |
| 6,784,616 | B2 * | 8/2004 | Akiba | 313/584 |

(Continued)

FOREIGN PATENT DOCUMENTS

JP 02-148645 6/1990

(Continued)

OTHER PUBLICATIONS

"*Final Draft International Standard*", Project No. 47C/61988-1/Ed. 1; Plasma Display Panels—Part 1: Terminology and letter symbols, published by International Electrotechnical Commission, IEC. in 2003, and Appendix A—Description of Technology, Annex B—Relationship Between Voltage Terms And Discharge Characteristics; Annex C—Gaps and Annex D—Manufacturing.

*Primary Examiner*—Edward J. Glick
*Assistant Examiner*—Thomas R Artman
(74) *Attorney, Agent, or Firm*—Robert E. Bushnell, Esq.

(57) ABSTRACT

A plasma display panel includes a first substrate, a second substrate mounted opposing the first substrate with a predetermined gap therebetween to thereby form a vacuum assembly, and barrier ribs formed between the first substrate and the second substrate, the barrier ribs defining discharge cells. The barrier ribs are formed so as to provide radial exhaust paths for each of the discharge cells. Moreover, the barrier ribs are configured dimensioned and arranged so as to maximize the exhaust efficiency of the plasma display panel.

44 Claims, 7 Drawing Sheets

U.S. PATENT DOCUMENTS

| | | | | |
|---|---|---|---|---|
| 6,787,978 | B2 * | 9/2004 | Yura et al. | 313/483 |
| 6,873,103 | B2 * | 3/2005 | Takada et al. | 313/582 |
| 7,002,296 | B2 * | 2/2006 | Sano et al. | 313/583 |
| 2001/0019318 | A1 * | 9/2001 | Sano et al. | 345/60 |
| 2002/0047519 | A1 * | 4/2002 | Kunii et al. | 313/584 |
| 2002/0063510 | A1 * | 5/2002 | Yura et al. | 313/483 |
| 2002/0163304 | A1 * | 11/2002 | Akiba | 313/584 |
| 2005/0001548 | A1 * | 1/2005 | Sawa et al. | 313/582 |

FOREIGN PATENT DOCUMENTS

| | | |
|---|---|---|
| JP | 4-6734 | 1/1992 |
| JP | 04-274141 | 9/1992 |
| JP | 08-031326 | 2/1996 |
| JP | 2845183 | 10/1998 |
| JP | 2917279 | 4/1999 |
| JP | 2001-043804 | 2/2001 |
| JP | 2001-93425 | 4/2001 |
| JP | 2001-126624 | 5/2001 |
| JP | 2001-325888 | 11/2001 |
| JP | 2002-083545 | 3/2002 |
| JP | 2002-134032 | 5/2002 |
| JP | 2002-190256 | 7/2002 |
| JP | 2002-197979 | 7/2002 |

* cited by examiner

PLASMA DISPLAY PANEL

CLAIM OF PRIORITY

This application makes reference to, incorporates the same herein, and claims all benefits accruing under 35 U.S.C. §119 from an application entitled PLASMA DISPLAY PANEL filed with the Korean Industrial Property Office on 17 Dec. 2002 and there duly assigned Serial No. 2002-0080804, and an application entitled PLASMA DISPLAY PANEL filed with the Korean Industrial Property Office on Jan. 15, 2003 and there duly assigned Serial No. 2003-0002682.

BACKGROUND OF THE INVENTION

1. Technical Field

The present invention relates to a plasma display panel and, more particularly, to barrier ribs of a plasma display panel.

2. Related Art

A plasma display panel (PDP) typically includes barrier ribs that define discharge cells. The two main types of barrier ribs are closed barrier ribs and open barrier ribs. The open barrier ribs are generally formed in a stripe configuration. Since discharge cells formed between such stripe-type barrier ribs are in communication (i.e., the discharge cells between each pair of adjacent barrier ribs are in communication), exhaust of the PDP and sealing of discharge gas within the PDP are relatively easily performed during manufacture.

With the closed barrier ribs, on the other hand, the discharge cells are not in communication. That is, the barrier ribs are formed into individual units having a quadrilateral, hexagonal, or other shape. With the closed barrier ribs, the discharge cells are separately formed for each pixel, and phosphor material is formed over all inner surfaces of barrier ribs that form each pixel.

In the first PDPs that utilized such closed barrier ribs, a gap formed between a distal end of the barrier ribs and the substrate opposing the substrate on which the barrier ribs are formed was used as an exhaust path. The gap was formed by adjusting the height of the barrier ribs or by forming depressions at predetermined locations of distal end areas of the barrier ribs. However, because of the minimal size of the gap, the resulting exhaust resistance necessitated the use of a significant amount of time to exhaust the PDP. This reduced overall manufacturing efficiency.

Various configurations have been disclosed to overcome these problems. For example, Japanese Laid-Open Patent No. Heisei 4-274141 discloses a structure in which open stripe-type barrier ribs and closed lattice-type barrier ribs are combined to reduce exhaust resistance. However, with such a combinational structure, the process of forming each barrier rib on the substrate during PDP manufacture is complicated. With this structure, productivity is reduced to such an extent that mass production is made difficult.

Japanese Laid-Open Patent No. Heisei 2002-83545 discloses a PDP in which closed barrier ribs are formed using a material that has a heat shrink property. The barrier ribs are formed having areas of lesser height that function as exhaust paths to thereby form a mesh-type structure of the exhaust paths. Although it is claimed that such a barrier rib structure reduces exhaust resistance during the exhaust process, in practice, there is a limited number of paths through which exhaust may occur as a result of the mesh configuration. This may result in insufficient exhaust of the PDP.

SUMMARY OF THE INVENTION

The present invention provides a plasma display panel including barrier ribs that maximize exhaust efficiency.

More particularly, the present invention provides a plasma display panel including barrier ribs that enable improvements in brightness through the efficient use of discharge cells.

In one embodiment, the present invention provides a plasma display panel including a first substrate, a second substrate mounted opposing the first substrate with a predetermined gap therebetween to thereby form a vacuum assembly, and barrier ribs formed between the first substrate and the second substrate, the barrier ribs defining discharge cells. Radial exhaust paths are formed in the barrier ribs for each of the discharge cells.

The discharge cells are formed in a closed configuration by the barrier ribs, and the discharge cells are arranged in a lattice pattern or a delta pattern.

In another embodiment, the present invention is a plasma display panel including a first substrate, a second substrate mounted opposing the first substrate with a predetermined gap therebetween to thereby form a vacuum assembly, and barrier ribs formed on the second substrate and extending a predetermined distance in a direction toward the first substrate, the barrier ribs defining discharge cells. A plan view of the barrier ribs is such that, if imaginary lines are formed bisecting distal end surfaces of the barrier ribs, the imaginary lines form a plurality of multilateral shapes that encompass each of the discharge cells to thereby form the discharge cells into the multilateral shapes. Also, if a radius of a first inscribed circle drawn in areas of the barrier ribs corresponding to corner portions of the multilateral shapes of the discharge cells is R, and a radius of a second inscribed circle drawn in areas corresponding to predetermined points between the corner portions of the multilateral shapes of the discharge cells is r, the following condition is satisfied:

$$R>r.$$

Alternatively, the barrier ribs may be formed so as to satisfy the following condition:

$$R>2r.$$

The barrier ribs are made of a material that has a heat shrink property, and widths of the distal end surfaces of the barrier ribs vary, in a continuous manner or in stages, along a direction in which the barrier ribs are formed.

Further, exhaust paths are formed in the barrier ribs such that one of the exhaust paths is formed in areas of the barrier ribs corresponding to each side of the multilateral discharge cells. The exhaust paths are formed in the distal ends of the barrier ribs.

The plasma display panel further includes sub exhaust paths formed in areas of the barrier ribs where corner portions of the multilateral shapes of the discharge cells converge. The sub exhaust paths are realized by exhaust grooves formed in the barrier ribs.

In another embodiment, the present invention is a plasma display panel including a first substrate, a second substrate mounted opposing the first substrate with a predetermined gap therebetween to thereby form a vacuum assembly, and barrier ribs formed on the second substrate and extending a predetermined distance in a direction toward the first substrate, the barrier ribs defining discharge cells. A plan view of the barrier ribs is such that, if imaginary lines are formed bisecting distal end surfaces of the barrier ribs, the imaginary lines form a plurality of multilateral shapes that encompass each of the discharge cells to thereby form the discharge cells into the multilateral shapes.

Also, the height of the barrier ribs, measured from where they are formed on the second substrate to the distal end of the same, is greater at areas corresponding to corner portions of the multilateral shapes of the discharge cells than at areas between the corner portions of the multilateral shapes of the discharge cells.

The height of the barrier ribs is at a maximum at areas corresponding to the corner portions of the multilateral shapes of the discharge cells, and the height of the barrier ribs is at a minimum at predetermined points between the corner portions of the multilateral shapes of the discharge cells.

A width of the distal ends of the barrier ribs at areas corresponding to the corner portions of the multilateral shapes of the discharge cells is greater than the width of the distal ends of the barrier ribs at areas between the corner portions of the multilateral shapes of the discharge cells.

Further, the heights of the barrier ribs vary in a continuous manner starting from where the heights are maximum and decreasing until reaching the minimum heights.

The present invention is more specifically described in the following paragraphs by reference to the drawings attached only by way of example. Other advantages and features will become apparent from following description and from the appended claims.

BRIEF DESCRIPTION OF THE DRAWINGS

A more complete appreciation of the invention, and many of the attendant advantages thereof, will be readily apparent as the same becomes better understood by reference to the following detailed description when considered in conjunction with the accompanying drawings in which like reference symbols indicate the same or similar components, wherein.

DETAILED DESCRIPTION OF THE INVENTION

Embodiments of the present invention will now be described in detail with reference to the accompanying drawings.

Figure 1:
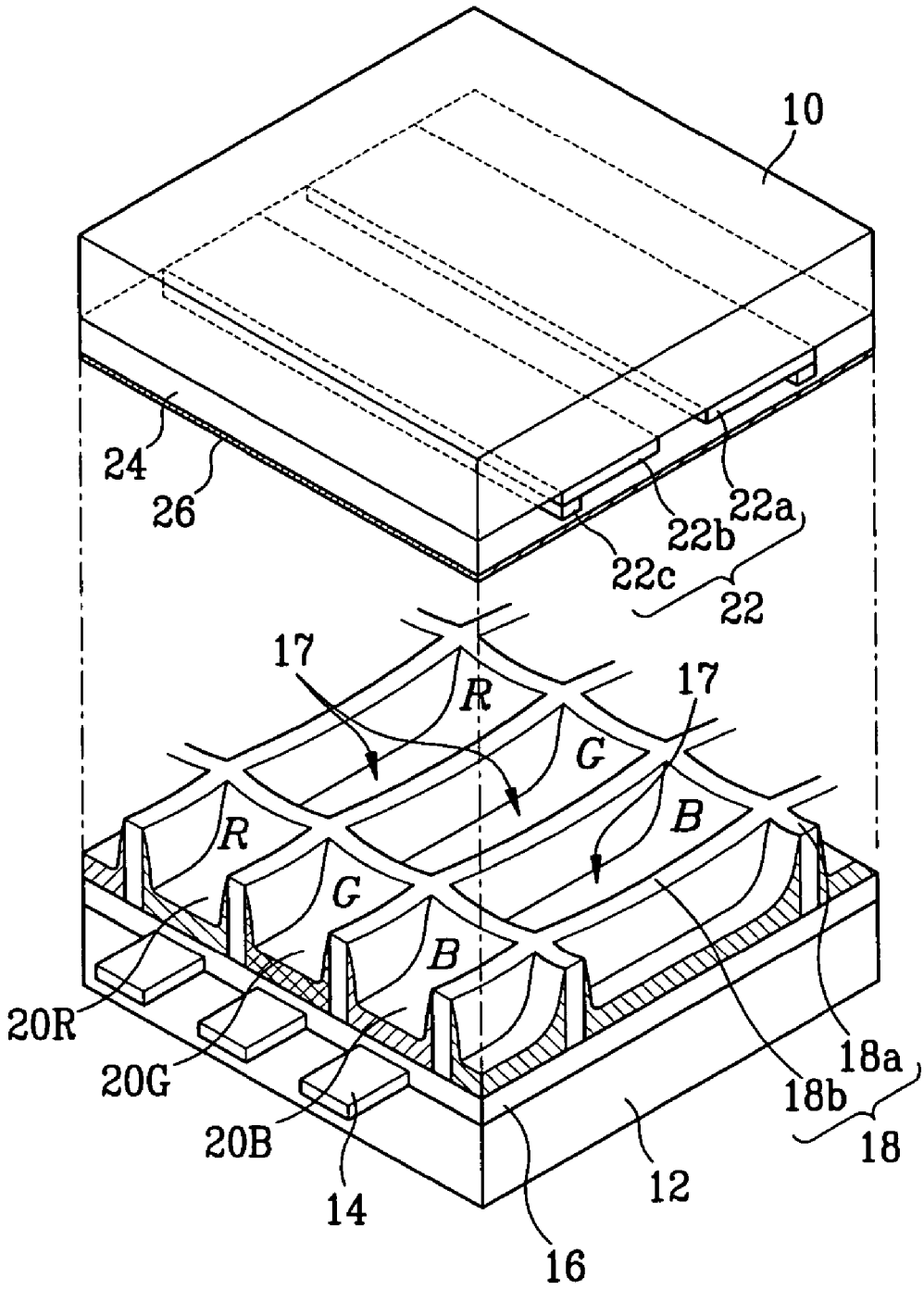
FIG. 1 is a partial exploded perspective view of a plasma display panel according to a first embodiment of the present invention.
Figure 2:
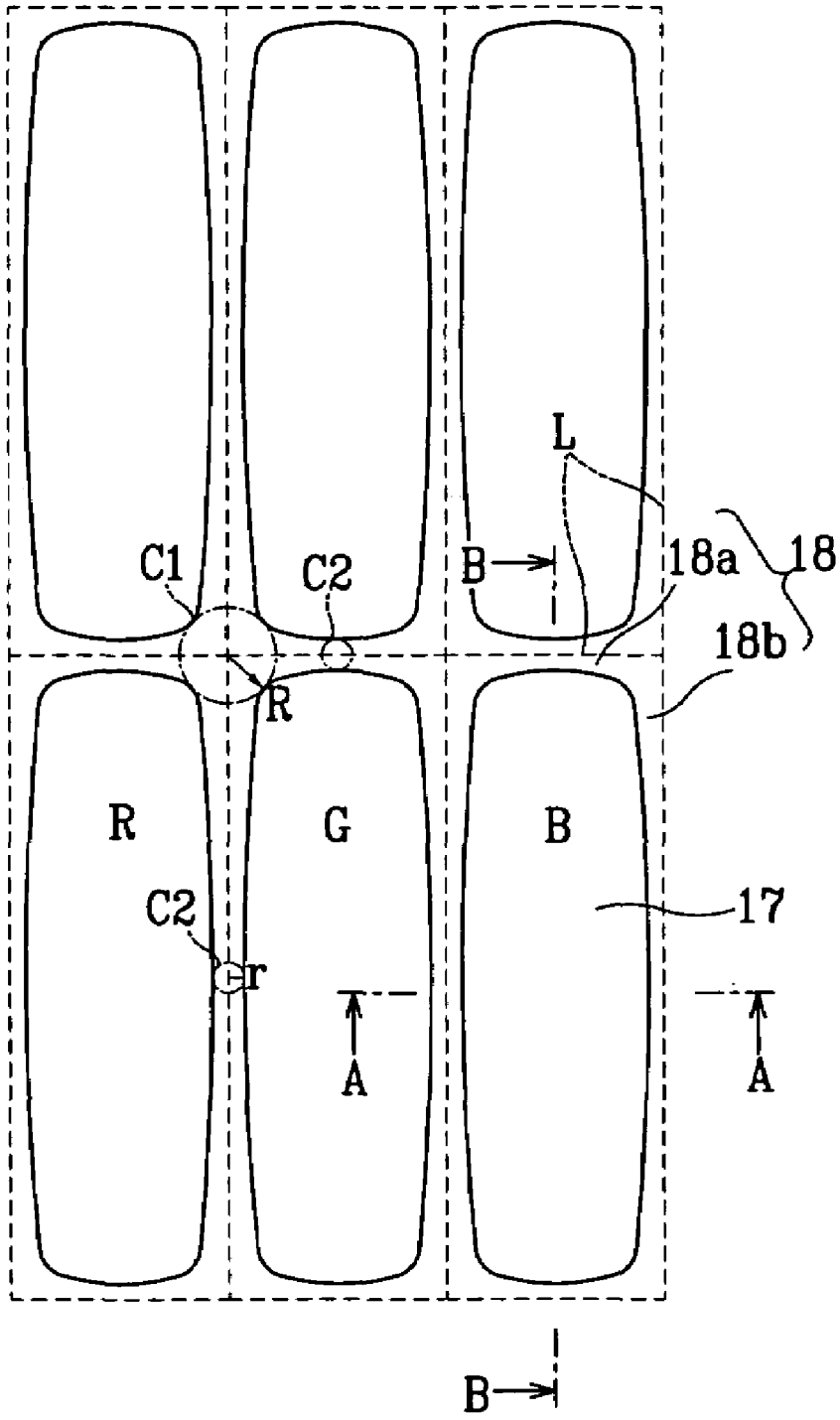
FIG. 2 is a plan view showing a structure of barrier ribs of FIG. 1.
Figure 3A:
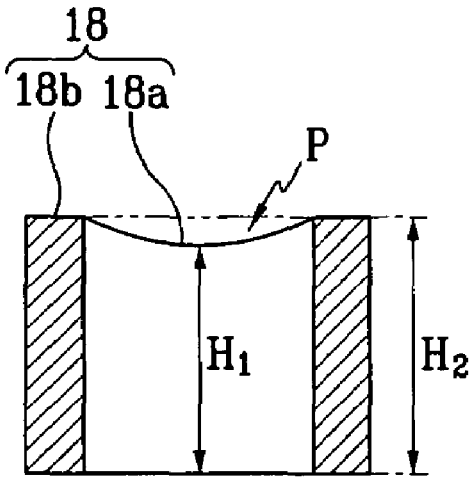
FIGS. 3A and 3B are sectional views taken along lines A—A and B—B of FIG. 2.
Figure 3B:
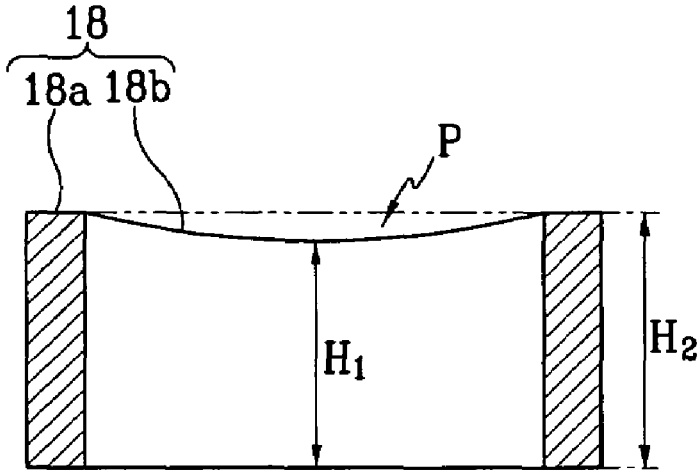

FIG. 1 is a partial exploded perspective view of a plasma display panel according to a first embodiment of the present invention, FIG. 2 is a plan view showing a structure of barrier ribs of FIG. 1, and FIGS. 3A and 3B are sectional views taken along lines A—A and B—B of FIG. 2.

With reference to the drawings, the plasma display panel (PDP) according to the first embodiment of the present invention includes a first substrate 10 and a second substrate 12 opposing one another with a predetermined gap therebetween. A vacuum assembly is formed by the combination of the first substrate 10 and the second substrate 12.

Address electrodes 14 are formed in a predetermined pattern (e.g., a stripe pattern) and at predetermined intervals on the second substrate 12. A first dielectric layer 16 is formed on the second substrate 12 and covers the address electrodes 14. Further, barrier ribs 18 are formed on the first dielectric layer 16 and in a predetermined pattern to define a plurality of discharge cells 17.

In the first embodiment, the barrier ribs 18 are made of a glass material having a low melting point. Regarding a plan view formation of the barrier ribs 18, with reference to FIGS. 1 and 2, in a state where imaginary lines L are formed bisecting distal end surfaces of the barrier ribs 18, the imaginary lines L form a plurality of multilateral shapes that encompass each of the discharge cells 17. In the first embodiment, the imaginary lines L are formed into a plurality of quadrilateral shapes.

The barrier ribs 18 include row sections 18*a* extending in a direction substantially perpendicular to the direction in which the address electrodes 14 are formed, and column sections 18*b* extending in a direction substantially parallel to the direction in which the address electrodes 14 are formed. Areas where the row sections 18*a* and the column sections 18*b* intersect, that is, areas of the barrier ribs 18 between four adjacent discharge cells 17, occupy a greater space than other areas of the barrier ribs 18. The formation of the barrier ribs 18, and, in particular, the relative widths of the barrier ribs 18, will be described in greater detail below.

As an example, areas of the barrier ribs 18 between four adjacent discharge cells 17 are the greatest among all areas of the barrier ribs 18, while areas of the barrier ribs 18 corresponding to centers of long sides and short sides of adjacent discharge cells 17 are the smallest among all areas of the barrier ribs 18. In particular, a radius R of a first inscribed circle C1 (see FIG. 2) drawn in one of the areas of the barrier ribs 18 between four adjacent discharge cells 17 is greater than a radius r of a second inscribed circle C2 (see FIG. 2) drawn in areas corresponding to the center of the long sides and short sides of adjacent discharge cells 17. That is, these radii R and r satisfy the condition R>r, and more preferably satisfy the condition R>2r.

With reference to FIGS. 3A and 3B, areas where the second inscribed circles C2 are drawn, that is, areas of the barrier ribs 18 corresponding to centers of the long sides and short sides of adjacent discharge cells 17 with the smallest widths, have a height H1 that is the smallest among all areas of the barrier ribs 18, while areas of the barrier ribs 18 between four adjacent discharge cells 17 have a height H2 that is the greatest among all areas of the barrier ribs 18.

With this configuration, gaps of predetermined dimensions are formed between the first substrate 10 and the distal ends of the row sections 18*a* and the column sections 18*b* of the barrier ribs 18 by the difference in the heights H1 and H2. Preferably, the difference in the heights H1 and H2 is between 5 and 10 μm. These gaps function as exhaust paths P through which air inside the PDP travels when forming a vacuum in the same during manufacture. As a result, radial paths P are provided for each of the discharge cells 17. In the first embodiment, four exhaust paths P are provided for each discharge cell 17.

The barrier ribs 18 are formed by a sandblast process, which is commonly used in the manufacture of PDPs. If a minimum width of the barrier ribs 18 that can be formed using the sandblast process is m, the radius r of the second inscribed circle C2 described above satisfies the condition:

$$2r<m.$$

Further, with reference to FIG. 2, the width of the row sections 18*a* and the column sections 18*b* of the barrier ribs 18 may be continuously (i.e., not abruptly and not in steps) made larger as the distance from their centers (where the inscribed circles C2 are formed) is increased. Also, with reference to FIGS. 3A and 3B, the heights of the row sections 18*a* and the column sections 18*b* may be continuously reduced starting from areas thereof where the heights are H2 and moving toward areas thereof where the heights are H1.

The barrier ribs 18 structured as described above are produced according to the following manufacturing method of the present invention.

First, in a state where the address electrodes 14 and the first dielectric layer 16 are formed on the second substrate 12, a barrier rib material layer of a predetermined thickness is realized through a paste, which is formed by uniformly mixing a vehicle and a glass powder having a low melting point, and the barrier rib material layer is formed on the first dielectric layer 16 using a screen printing method or a laminate method. The glass powder of a low melting point may be made, for example, of a material containing 50~60 wt % of Pbo, 5~10 wt % of $B_2O_3$, 10~20 wt % of $SiO_2$, 15~25 wt % of $Al_2O_2$, and 5% or less of CaO.

Following the drying of the barrier rib material layer, a photosensitive dry film is formed or a resist material is deposited. Then, using a photolithography process that includes exposure and development, a cut mask is formed in a lattice pattern corresponding to the desired shape of barrier ribs. The dimensions of the mask pattern are set to be greater than the desired dimensions of the barrier ribs since thermal contraction of the barrier rib material layer occurs.

Next, using a sandblast process, non-masked portions of the barrier rib material layer are removed until the dielectric layer is exposed. Heating and baking are then performed to thereby complete the formation of the barrier ribs.

The cut mask has a pattern corresponding to the various shapes of the barrier ribs 18 as described above.

Red, green, and blue phosphor layers 20R, 20G, and 20B (see FIG. 1) are deposited on areas of the first dielectric layer 16 positioned within the discharge cells 17 and on inner surfaces of the barrier ribs 18 within the discharge cells 17 to thereby form corresponding pixels (i.e., R, G, and B pixels). In the first embodiment, the discharge cells 17 are arranged in a lattice pattern wherein each of the discharge cells is individually formed in fully closed units by the barrier ribs 18.

Further, formed on a surface of the first substrate 10, opposing the second substrate 12, are discharge sustain electrodes 22 that include common electrodes 22*a*, scanning electrodes 22*b*, and bus electrodes 22*c* formed on each of the common electrodes 22*a* and the scanning electrodes 22*b* The common electrodes 22*a* and the scanning electrodes 22*b* are made of a transparent material, such as indium tin oxide (ITO), and the bus electrodes 22*c* are made of a conductive material, such as silver (Ag) or gold (Au).

The discharge sustain electrodes 22 are formed in a direction substantially perpendicular to the direction in which the address electrodes 14 are formed. A second dielectric layer 24 is formed on the first substrate 10 covering the discharge sustain electrodes 22, and a protective layer 26 made of MgO is formed over the second dielectric layer 24. The protective layer 26 acts to protect the discharge sustain electrodes 22, and functions also to aid discharge by emitting secondary electrons.

In the PDP having the closed barrier rib structure as described above, there are provided radial exhaust paths P for each of the discharge cells 17 such that exhaust efficiency is significantly improved over the prior art.

Figure 4:
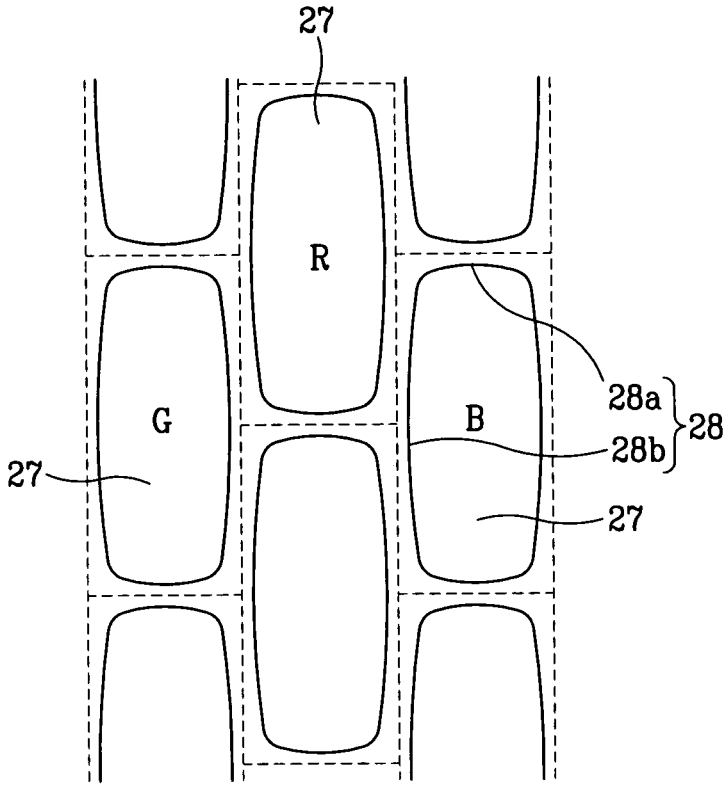
FIG. 4 is a plan view showing a structure of barrier ribs according to a second embodiment of the present invention.

FIG. 4 is a plan view showing the structure of barrier ribs according to a second embodiment of the present invention. Barrier ribs 28 according to the second embodiment have the basic structure of the barrier ribs of the first embodiment. However, row sections 28*a* of the barrier ribs 28 that define discharge cells 27 are positioned differently. In particular, the row sections 28*a* of the barrier ribs 28 of adjacent discharge cells 27 (i.e., adjacent in a direction in which the row sections 28*a* are formed) are offset and not aligned as in the first embodiment. As a result, the discharge cells 27 defined by the barrier ribs 28 are arranged in a delta pattern.

Figure 5:
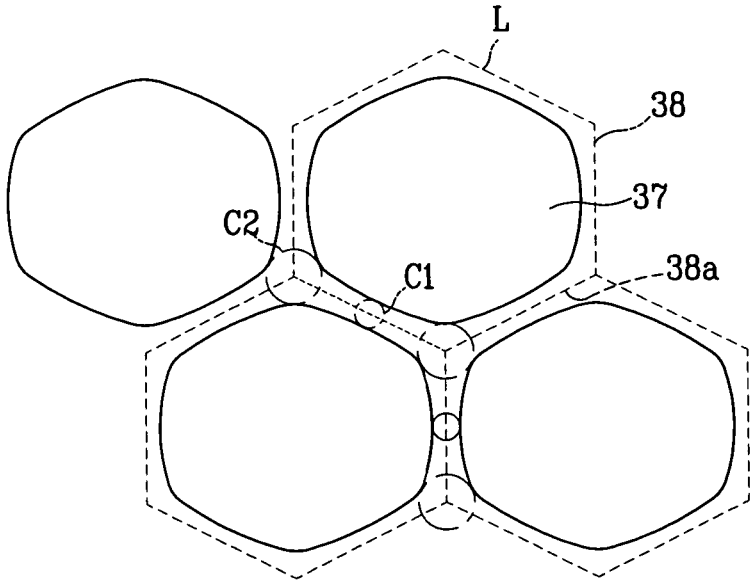
FIGS. 5, 6, and 7 are plan views showing a structure of barrier ribs according to a third embodiment of the present invention.
Figure 6:
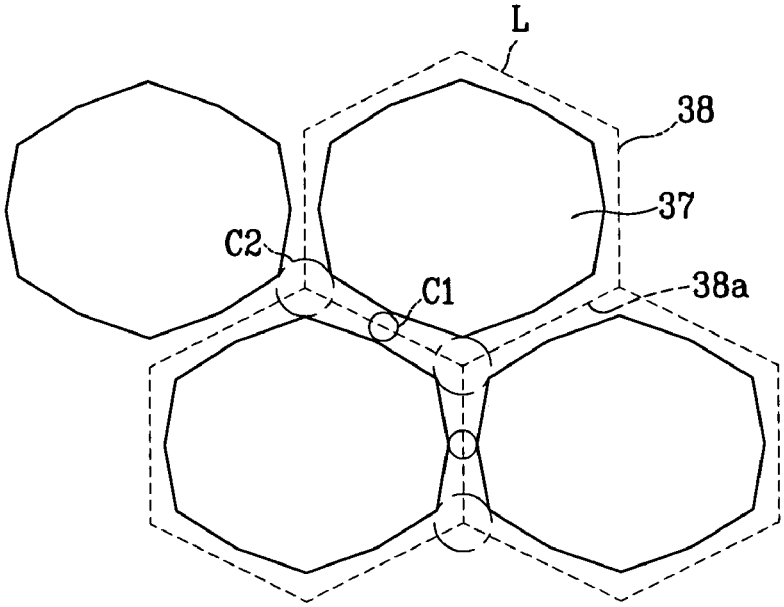
Figure 7:
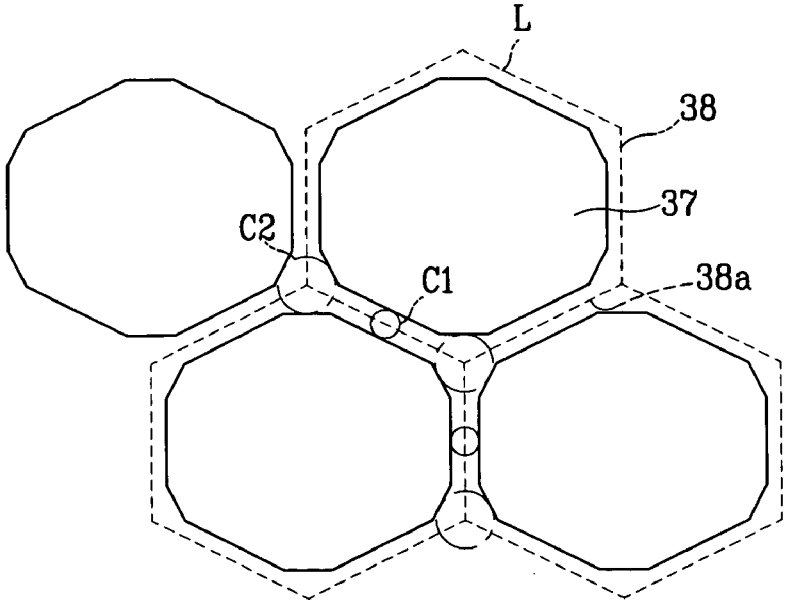

FIGS. 5, 6, and 7 are plan views showing the structure of barrier ribs according to a third embodiment of the present invention. FIG. 5 shows a structure in which imaginary lines L bisecting distal end surfaces of barrier ribs 38 are formed into a plurality of hexagonal shapes. Stated differently, the barrier ribs 38 are formed to define a plurality of discharge cells 37 such that the discharge cells 37 are formed as individual, closed units in the shape of a hexagon or a similar form. As a result of this configuration, the discharge cells 37 may be arranged in a delta configuration.

In the third embodiment, areas of the barrier ribs 38 between any three, mutually adjacent discharge cells 37 occupy the largest area and have the greatest height when compared to other areas of the barrier ribs 38, that is, main sections 38*a* of the barrier ribs 38. This results in the formation of exhaust paths in the main sections 38*a* of the barrier ribs 38. Since there is a larger number of exhaust paths for each of the discharge cells 37 than in the first embodiment, an even greater improvement in exhaust efficiency is realized.

The basic configuration of FIGS. 5, 6 and 7 shows the barrier ribs 38 defining the discharge cells 37 such that the discharge cells 37 are formed as closed, 12-sided individual units. As shown in FIG. 6, the twelve sides forming each of the discharge cells 37 are substantially equal in length, and the barrier ribs 38 are placed in relation to one another such that the main sections 38*a* between adjacent discharge cells 37 have a width that increases as the distance from the center of the main sections 38*a* increases.

In FIG. 7, the twelve sides forming each of the discharge cells 37 are not equal in length. That is, the sides that form the main sections 38*a* are longer than the sides in areas where three, mutually adjacent discharge cells 37 converge. Therefore, the widths of the barrier ribs 38 along the main sections 38*a* remain constant.

Figure 8:
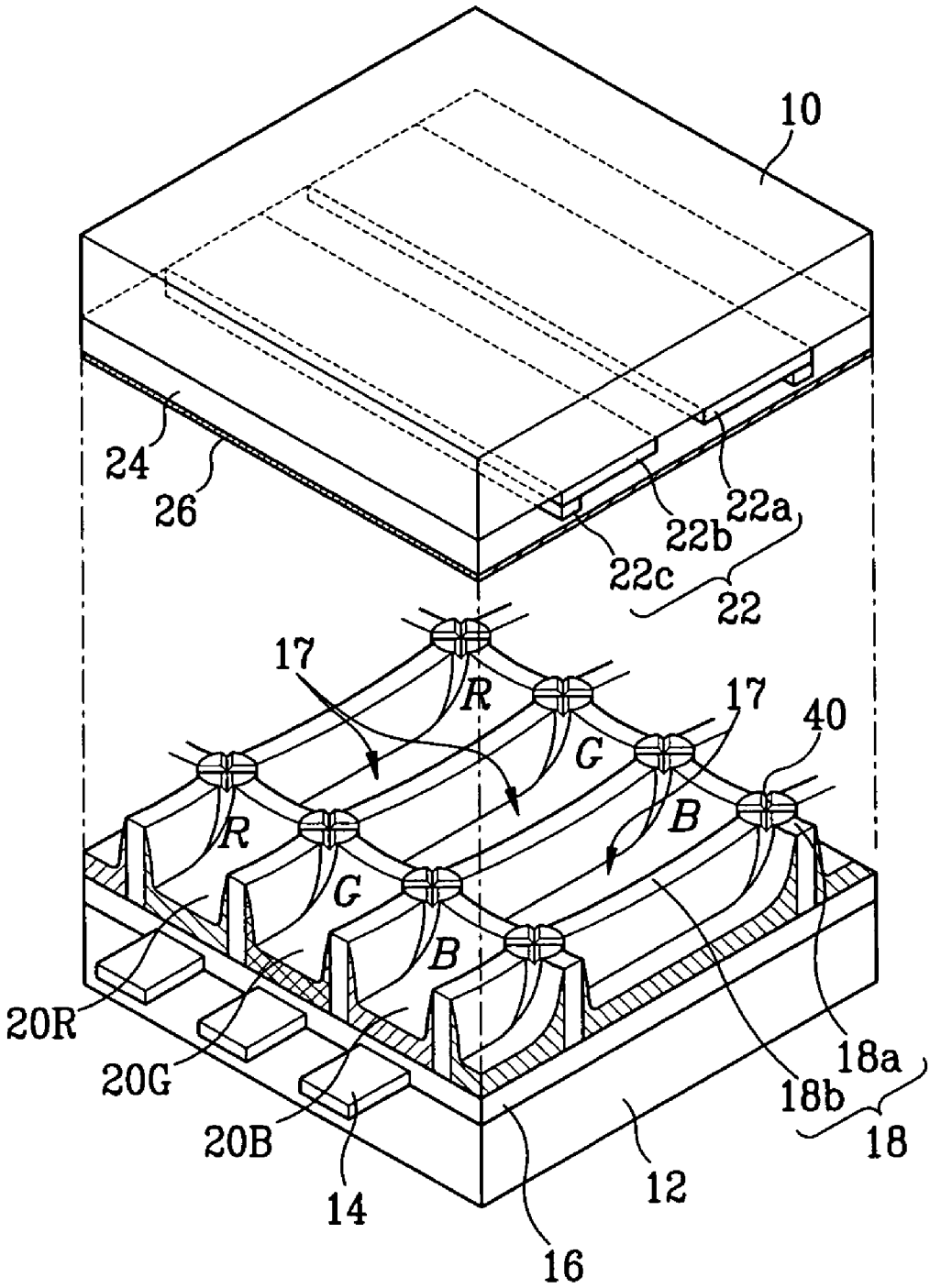
FIG. 8 is a partial exploded perspective view of a plasma display panel according to a fourth embodiment of the present invention.

FIG. 8 is a partial exploded perspective view of a plasma display panel according to a fourth embodiment of the present invention. Like reference numerals will be used for elements of the fourth embodiment identical to those of the first embodiment.

The PDP of the fourth embodiment of the present invention utilizes the same basic structure as the PDP of the first embodiment. However, sub exhaust paths 40 are formed at areas where the row sections 18*a* and the column sections 18*b* intersect, that is, at areas of the barrier ribs 18 between four adjacent discharge cells 17.

Figure 9:
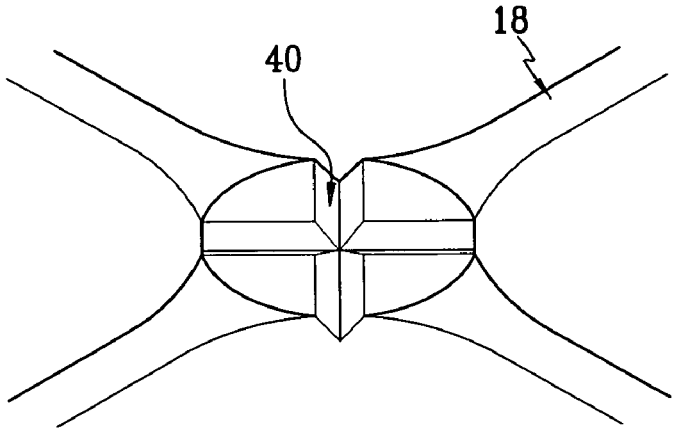
FIG. 9 is an enlarged perspective view of a sub exhaust path of FIG. 8.

The sub exhaust paths 40 are formed to enable communication between adjacent discharge cells 17 to thereby improve the exhaust process. With reference also to FIG. 9, the sub exhaust paths 40 are realized by forming exhaust grooves in the barrier ribs 18. The sub exhaust paths 40 may be formed in a simple manner using an etching process. As an example, the exhaust grooves may be formed to a width of 10~100 μm and a depth of 10~130 μm.

With the PDP of the fourth embodiment, in addition to the radial exhaust paths formed by the particular configuration of the row sections 18*a* and the column sections 18*b* of the barrier ribs 18 as described with reference to the first embodiment, the sub exhaust paths 40 act to even further improve exhaust efficiency.

Figure 10:
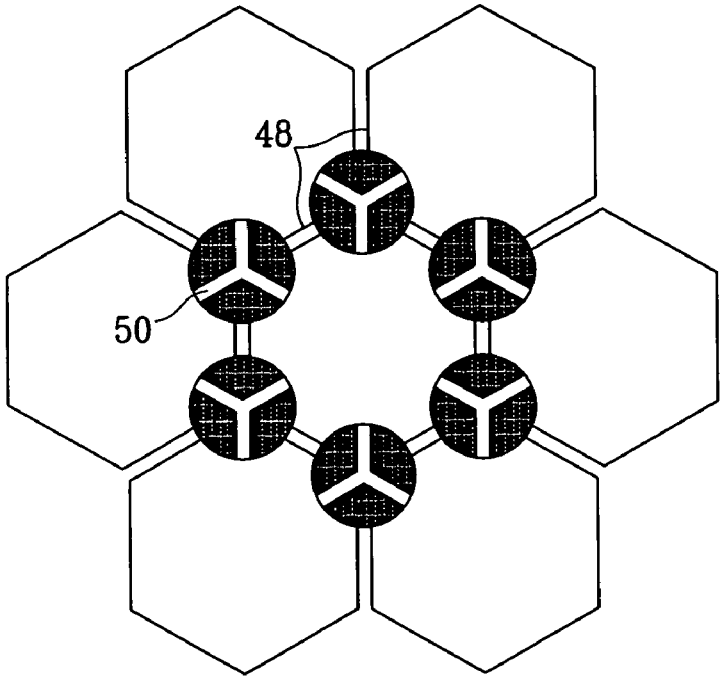
FIG. 10 is a partial plan view of a plasma display panel according to a fifth embodiment of the present invention.

FIG. 10 is a partial plan view of a plasma display panel according to a fifth embodiment of the present invention. In the fifth embodiment, sub exhaust paths 50 are formed on barrier ribs 48 in the case where the barrier ribs 48 are formed to realize a delta pattern of discharge cells. Although the sub exhaust paths 50 are formed at each corner area between adjacent discharge cells, it is also possible to form the sub exhaust paths 50 at other selective locations.

While the present invention has been illustrated by the description of embodiment thereof, and while the embodiments have been described in considerable detail, it is not intended to restrict or in any way limit the scope of the appended claims to such detail. Additional advantages and modifications will readily appear to those skilled in the art. Therefore, the invention in its broader aspects is not limited to the special details, representative apparatus and method, and illustrative examples shown and described. Accordingly, departures may be made from such details without departing from the sprit and scope of the general inventive concept.

What is claimed is:

1. A plasma display panel, comprising:

a first substrate;

a second substrate opposing the first substrate with a predetermined gap therebetween to form a vacuum assembly; and barrier ribs formed between the first substrate and the second substrate, the barrier ribs defining discharge cells;

wherein the barrier ribs form radial exhaust paths for each of the discharge cells; and wherein the barrier ribs are made of a material having a heat shrink property, whereby a volume of the barrier ribs material contracts during heating and baking so as to form the radial exhaust paths;

said plasma display panel further comprising sub exhaust paths formed in areas of the barrier ribs where corner portions of multilateral shapes of the discharge cells converge.

2. The plasma display panel of claim 1, wherein the discharge cells are formed in a closed configuration by the barrier ribs.

3. The plasma display panel of claim 2, wherein the discharge cells are arranged in a lattice pattern.

4. The plasma display panel of claim 2, wherein the discharge cells are arranged in a delta pattern.

5. A plasma display panel, comprising:

a first substrate;

a second substrate opposing the first substrate with a predetermined gap therebetween to form a vacuum assembly; and barrier ribs formed on the second substrate and extending a predetermined distance in a direction toward the first substrate, the barrier ribs defining discharge cells;

wherein a structure of the barrier ribs is such that, if imaginary lines are formed bisecting distal end surfaces of the barrier ribs, the imaginary lines form a plurality of multilateral shapes that encompass each of the discharge cells so that the structure of the barrier ribs forms the discharge cells into the multilateral shapes; and wherein, if a radius of a first inscribed circle drawn in areas of the barrier ribs corresponding to corner portions of the multilateral shapes of the discharge cells is R, and a radius of a second inscribed circle drawn in areas corresponding to points between the corner portions of the multilateral shapes of the discharge cells is r, the following condition is satisfied:

$$R>2r.$$

6. The plasma display panel of claim 5, wherein the barrier ribs are made of a material having a heat shrink property, whereby a volume of the barrier ribs material contracts during heating and baking so as to form radial exhaust paths.

7. The plasma display panel of claim 5, wherein widths of the distal end surfaces of the barrier ribs vary in stages along a direction in which the barrier ribs are formed.

8. The plasma display panel of claim 5, wherein exhaust paths are formed in the barrier ribs, respective exhaust paths being formed in respective areas of the barrier ribs corresponding to respective sides of the discharge cells.

9. The plasma display panel of claim 8, wherein the exhaust paths are formed in distal ends of the barrier ribs.

10. The plasma display panel of claim 8, further comprising sub exhaust paths formed in areas of the barrier ribs where the corner portions of the multilateral shapes of the discharge cells converge.

11. The plasma display panel of claim 10, wherein the sub exhaust paths are realized by exhaust grooves formed in the barrier ribs.

12. A plasma display panel, comprising:

a first substrate;

a second substrate opposing the first substrate with a predetermined gap therebetween to form a vacuum assembly; and barrier ribs formed on the second substrate and extending a predetermined distance in a direction toward the first substrate, the barrier ribs defining discharge cells;

wherein widths of distal end surfaces of the barrier ribs vary in one of a continuous manner and stages along a direction in which the barrier ribs are formed; and wherein exhaust paths are formed in the barrier ribs, respective exhaust paths being formed in respective areas of the barrier ribs corresponding to respective sides of the discharge cells;

said plasma display panel further comprising sub exhaust paths formed in areas of the barrier ribs where corner portions of the discharge cells converge.

13. The plasma display panel of claim 12, wherein a height of said each barrier rib is at a maximum at corner portions of the discharge cells.

14. The plasma display panel of claim 12, wherein a height of said each barrier rib is at a minimum at points between corner portions of the discharge cells.

15. The plasma display panel of claim 14, wherein the points are substantially at centers between any two corner portions of the discharge cells.

16. The plasma display panel of claim 12, wherein the barrier ribs are made of a material having a heat shrink property, whereby a volume of the barrier ribs material contracts during heating and baking so as to form radial exhaust paths.

17. The plasma display panel of claim 12, wherein the exhaust paths are formed in distal ends of the barrier ribs.

18. The plasma display panel of claim 12, wherein the sub exhaust paths are realized by exhaust grooves formed in the barrier ribs.

19. A plasma display panel, comprising:

a first substrate;

a second substrate opposing the first substrate with a predetermined gap therebetween to form a vacuum assembly; and barrier ribs formed on the second substrate and extending a predetermined distance in a direction toward the first substrate, the barrier ribs defining discharge cells;

said plasma display panel further comprising sub exhaust paths formed in areas of the barrier ribs where corner portions of multilateral shapes of the discharge cells converge.

20. The plasma display panel of claim 19, wherein the sub exhaust paths are realized by exhaust grooves formed in the barrier ribs.

21. The plasma display panel of claim 19, wherein a height of each barrier rib is at a maximum at the corner portions of the discharge cells.

22. The plasma display panel of claim 19, wherein a height of each barrier rib is at a minimum at points between the corner portions of the discharge cells.

23. The plasma display panel of claim 22, wherein the points are substantially at centers between any two corner portions of the discharge cells.

24. The plasma display panel of claim 19, wherein the barrier ribs are made of a material having a heat shrink property, whereby the barrier ribs do not lose shape at high temperatures.

25. The plasma display panel of claim 19, wherein exhaust paths are formed in the barrier ribs, respective exhaust paths being formed in respective areas of the barrier ribs corresponding to respective sides of the discharge cells.

26. The plasma display panel of claim 25, wherein the exhaust paths are formed in distal ends of the barrier ribs.

27. The plasma display panel of claim 25, further comprising sub exhaust paths formed in areas of the barrier ribs where the corner portions of the discharge cells converge.

28. The plasma display panel of claim 27, wherein the sub exhaust paths are realized by exhaust grooves formed in the barrier ribs.

29. A plasma display panel, comprising:

a first substrate;

a second substrate opposing the first substrate with a predetermined gap therebetween to form a vacuum assembly; and barrier ribs formed on the second substrate and extending a predetermined distance in a direction toward the first substrate, the barrier ribs defining discharge cells;

wherein a width of a distal end of each barrier rib at areas corresponding to corner portions of multilateral shapes of the discharge cells is greater than a width of a distal end of said each barrier rib at areas between the corner portions of the multilateral shapes of the discharge cells;

wherein the barrier ribs are made of a material having a heat shrink property, whereby a volume of the barrier ribs material contracts during heating and baking so as to form the radial exhaust paths; and wherein, if a radius of a first inscribed circle drawn in areas of the barrier ribs corresponding to the corner portions of the multilateral shapes of the discharge cells merge is R, and a radius of a second inscribed circle drawn in areas corresponding to points between the corner portions of the multilateral shapes of the discharge cells is r, the following condition is satisfied:

$$R>2r.$$

30. The plasma display panel of claim 29, wherein a height of said each barrier rib is at a maximum at the corner portions of the multilateral shapes of the discharge cells.

31. The plasma display panel of claim 29, wherein a height of said each barrier rib is at a minimum at points between the corner portions of the multilateral shapes of the discharge cells.

32. The plasma display panel of claim 31, wherein the points are substantially at centers between any two corner portions of the multilateral shapes of the discharge cells.

33. The plasma display panel of claim 29, wherein a height of each barrier rib is at a maximum at corner portions of multilateral shapes of the discharge cells, the height of said each barrier rib is at a minimum at points between the corner portions of the multilateral shapes of the discharge cells, and the heights of the barrier ribs vary in a continuous manner starting from maximum heights to minimum heights.

34. The plasma display panel of claim 29, wherein the discharge cells are formed in a closed configuration by the barrier ribs.

35. The plasma display panel of claim 34, wherein the discharge cells are arranged in a lattice pattern.

36. The plasma display panel of claim 34, wherein the discharge cells are arranged in a delta pattern.

37. A plasma display panel, comprising:

a first substrate;

a second substrate opposing the first substrate with a predetermined gap therebetween to form a vacuum assembly; and barrier ribs formed on the second substrate and extending a predetermined distance in a direction toward the first substrate, the barrier ribs defining discharge cells;

wherein a width of a distal end of each barrier rib at areas corresponding to corner portions of multilateral shapes of the discharge cells is greater than a width of a distal end of said each barrier rib at areas between the corner portions of the multilateral shapes of the discharge cells; and wherein exhaust paths are formed in the barrier ribs, respective exhaust paths being formed in respective areas of the barrier ribs corresponding to respective sides of the discharge cells;

said plasma display panel further comprising sub exhaust paths formed in areas of the barrier ribs where corner portions of multilateral shapes of the discharge cells converge.

38. The plasma display panel of claim 37, wherein the exhaust paths are formed in the distal ends of the barrier ribs.

39. The plasma display panel of claim 37, wherein the sub exhaust paths are realized by exhaust grooves formed in the barrier ribs.

40. A plasma display panel, comprising:

a first substrate;

a second substrate opposing the first substrate with a predetermined gap therebetween to form a vacuum assembly; and barrier ribs formed on the second substrate and extending a predetermined distance in a direction toward the first substrate, the barrier ribs defining discharge cells;

wherein a width of a distal end of each barrier rib at areas corresponding to corner portions of multilateral shapes of the discharge cells is greater than a width of a distal end of said each barrier rib at areas between the corner portions of the multilateral shapes of the discharge cells;

said plasma display panel further comprising sub exhaust paths formed in areas of the barrier ribs where corner portions of the discharge cells converge.

41. The plasma display panel of claim 40, wherein the sub exhaust paths are realized by exhaust grooves formed in the barrier ribs.

42. A plasma display panel, comprising:

a first substrate;

a second substrate opposing the first substrate with a predetermined gap therebetween to form a vacuum assembly; and barrier ribs formed between the first substrate and the second substrate, the barrier ribs defining discharge cells;

wherein the barrier ribs form exhaust paths for the discharge cells and respective exhaust paths are formed in respective areas of the barrier ribs corresponding to respective sides of the discharge cells;

said plasma display panel further comprising sub exhaust paths formed in areas of the barrier ribs where corner portions of the discharge cells converge.

43. The plasma display panel of claim 42, wherein the exhaust paths are formed in distal ends of the barrier ribs.

44. The plasma display panel of claim 42, wherein the sub exhaust paths are realized by exhaust grooves formed in the barrier ribs.

* * * * *